US007650970B2

(12) United States Patent
Lelic et al.

(10) Patent No.: US 7,650,970 B2
(45) Date of Patent: Jan. 26, 2010

(54) ELEVATOR DOOR LOCK SENSOR DEVICE INCLUDING PROXIMITY SENSOR ELEMENTS IN A SELECTED GEOMETRIC PATTERN

(75) Inventors: Muhidin A. Lelic, Manchester, CT (US); Pei-Yuan Peng, Manchester, CT (US); Bryan Robert Siewert, Westbrook, CT (US); Jacek F. Gieras, Glastonbury, CT (US); Michael Tracey, Cromwell, CT (US); Thomas Malone, Avon, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 11/570,892

(22) PCT Filed: Sep. 27, 2004

(86) PCT No.: PCT/US2004/031729

§ 371 (c)(1),
(2), (4) Date: Dec. 19, 2006

(87) PCT Pub. No.: WO2006/036146

PCT Pub. Date: Apr. 6, 2006

(65) Prior Publication Data

US 2008/0271955 A1 Nov. 6, 2008

(51) Int. Cl.
*B66B 13/14* (2006.01)

(52) U.S. Cl. ..... 187/316; 187/391

(58) Field of Classification Search ..... 187/247, 187/313, 316, 317, 391–394; 49/26, 28
See application file for complete search history.

(56) References Cited

U.S. PATENT DOCUMENTS

| | | | |
|---|---|---|---|
| 1,344,430 | A | 6/1920 | Wigmore et al. |
| 3,554,326 | A | 1/1971 | Hallene et al. |
| 3,638,762 | A | 2/1972 | Johns |
| 4,410,067 | A | 10/1983 | Leiner et al. |
| 4,934,488 | A | 6/1990 | Umemura |
| 5,174,417 | A | 12/1992 | Pilsbury |

(Continued)

FOREIGN PATENT DOCUMENTS

| | | |
|---|---|---|
| JP | 3102091 | 4/1991 |

(Continued)

OTHER PUBLICATIONS

PCT International Preliminary Report on Patentability relating to International Application No. PCT/US2004/031729 mailed Feb. 14, 2007.

*Primary Examiner*—Jonathan Salata
(74) *Attorney, Agent, or Firm*—Carlson, Gaskey & Olds PC

(57) ABSTRACT

An elevator door lock assembly (30) includes a sensor device (40) for providing an indication of a properly locked door. A plurality of proximity sensor elements (42, 44) interact with activating elements (52, 54) when the door lock assembly (30) is properly locked. In disclosed examples, a specific geometric pattern of the sensor elements (42, 44) and the activating elements (52, 54) provides redundancy and tampering protection. In a disclosed example, an output from the sensor device (40) provides an indication of a condition of the door lock and a building level location of a plurality of sensor devices.

20 Claims, 2 Drawing Sheets

U.S. PATENT DOCUMENTS

| | | | | |
|---|---|---|---|---|
| 5,476,157 | A | 12/1995 | Todaro | |
| 5,616,895 | A * | 4/1997 | Spiess | 187/280 |
| 5,730,254 | A | 3/1998 | Nguyen | |
| 5,819,877 | A | 10/1998 | Rivera et al. | |
| 5,894,911 | A | 4/1999 | Bozogzadeh et al. | |
| 6,021,871 | A | 2/2000 | Grabner | |
| 6,070,700 | A | 6/2000 | Nagel | |
| 6,193,019 | B1 * | 2/2001 | Sirigu et al. | 187/391 |
| 6,382,362 | B1 * | 5/2002 | Kutz | 187/316 |
| 6,446,759 | B1 | 9/2002 | Kulak et al. | |
| 6,467,585 | B1 | 10/2002 | Gozzo et al. | |
| 6,495,821 | B1 | 12/2002 | Smith et al. | |
| 6,732,839 | B2 | 5/2004 | Schuster | |
| 7,097,001 | B2 * | 8/2006 | Martin | 187/316 |
| 7,350,625 | B2 * | 4/2008 | Deplazes et al. | 187/393 |
| 2004/0055829 | A1 | 3/2004 | Morris et al. | |

FOREIGN PATENT DOCUMENTS

| | | | |
|---|---|---|---|
| WO | 2006009536 | A3 | 1/2006 |
| WO | 2006009547 | A1 | 1/2006 |
| WO | 2006014164 | A3 | 2/2006 |
| WO | 2006041450 | A2 | 4/2006 |

* cited by examiner

ELEVATOR DOOR LOCK SENSOR DEVICE INCLUDING PROXIMITY SENSOR ELEMENTS IN A SELECTED GEOMETRIC PATTERN

FIELD OF THE INVENTION

This invention generally relates to elevator systems. More particularly, this invention relates to elevator door lock systems.

DESCRIPTION OF THE RELATED ART

Elevator systems typically include a plurality of elevator doors. Some doors travel with the elevator car as it moves up and down within a hoistway, for example. Other doors are located at each landing, providing access to the hoistway or the elevator car when the car is at a particular landing. Various door arrangements are known.

It is necessary to keep the doors in a locked condition at various stages of elevator system operation. For example, when the elevator car is not at a landing, the corresponding hoistway doors should be kept locked. Current safety codes require an arrangement for detecting when an elevator door is not properly locked. In many situations, an elevator system controller prevents operation of the elevator system when a door is not properly locked.

Typical arrangements include mechanical switches for detecting when an elevator door lock is properly locked. Such arrangements have proven useful but are not without difficulties and shortcomings. For example, it is easy for an individual to defeat the function of a mechanical switch using readily available tools to "trick" the controller regarding the condition of the door lock. Additionally, the contact surfaces associated with mechanical switches are often subjected to dirt, corrosion or damage, which requires periodic cleaning and inspection. Additionally, the shunt and spring components of mechanical switches tend to wear over time and require periodic cleaning and inspection.

There is a need for an improved sensor arrangement for providing an indication of a properly locked elevator door. This invention addresses that need.

SUMMARY OF THE INVENTION

An example sensor device for determining a condition of an elevator door lock includes a plurality of proximity sensor elements arranged in a selected geometric pattern. A plurality of activating elements are arranged in a corresponding geometric pattern. Each of the activating elements interacts with a corresponding one of the sensor elements when the activating elements are positioned relative to the sensor elements in a manner corresponding to a locked condition of the elevator door lock.

In one example, the proximity sensor elements comprise hall effect sensor elements and the activating elements comprise magnets.

In one example, an output circuit associated with the sensor elements provides an indication that the door lock is in a locked condition only when each of the activating elements properly interacts with each of the sensor elements. In one example, the output circuit provides an output that indicates a location such as the building level of each door lock sensor device. Such location information is particularly useful when a mechanic or technician is troubleshooting or trying to locate an improperly unlocked door.

Another example sensor device for determining a condition of an elevator door lock includes at least one proximity sensor element that senses whether the lock is in a locked condition. An output circuit provides an output indicative of whether the lock is in a locked condition and indicative of a building level location of the device. In one example, a controller receives the indications from the output circuits and determines whether an elevator door lock at each of the building levels is in a locked condition.

The various features and advantages of this invention will become apparent to those skilled in the art from the following detailed description of currently preferred embodiments. The drawings that accompany the detailed description can be briefly described as follows.

DETAILED DESCRIPTION OF THE PREFERRED EMBODIMENTS

Figure 1:
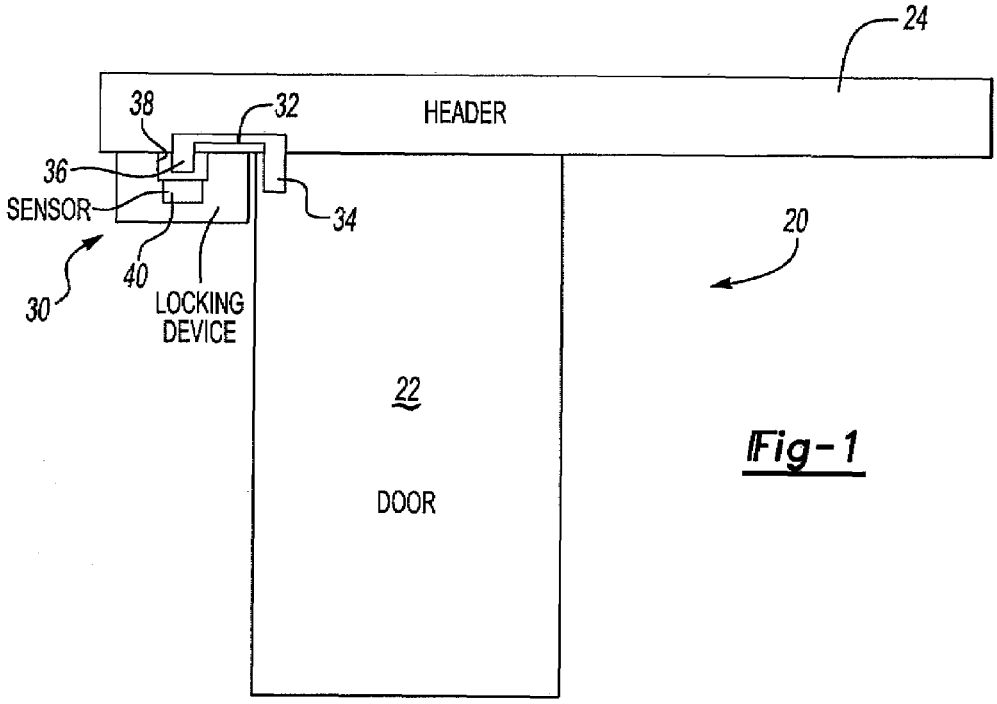
FIG. 1 schematically illustrates selected components of an elevator door assembly including a sensor device designed according to an embodiment of this invention.

FIG. 1 schematically illustrates an elevator door assembly 20. A door panel 22 is supported in a known manner for moving relative to a header 24. In the illustrated example, the door panel 22 slides horizontally between open and closed positions.

A locking device 30 is associated with the door panel 22 and the header 24 in a generally known manner. A locking member 32 in this example is pivotally supported at 34 on the door 22. The example locking member 32 has a locking portion 36 that is received within a receiver 38, which remains stationary relative to the header 24. When the locking portion 36 is received within the receiver 38, the door 22 is properly locked.

The example of FIG. 1 includes a sensor device 40 for detecting when the door lock assembly 30 is in a properly locked condition. The sensor device 40 includes at least one proximity sensor element for sensing when the locking portion 36 is properly received within the receiver 38, for example. The term "proximity sensor" is used in this description to refer to sensor devices that provide a sensing function without requiring mechanical or physical contact. Examples include Hall effect sensors, inductive sensors and opto-electronic sensors. Using proximity sensors avoids the shortcomings and drawbacks associated with mechanical switches. Moreover, additional sensor features become possible in an economically feasible manner as described below.

Figure 2:
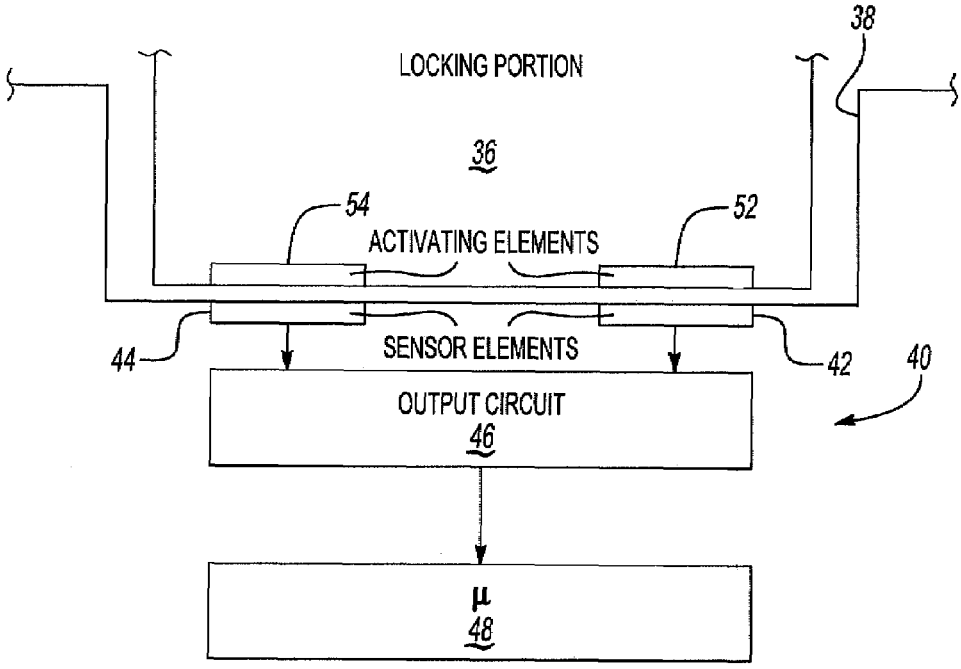
FIG. 2 schematically illustrates selected portions of a sensor arrangement designed according to an embodiment of this invention.

One example sensor device arrangement is shown in FIG. 2. In this example, a plurality of proximity sensor elements 42 and 44 are supported on the receiver 38. The sensor elements 42 and 44 provide an indication to an output circuit 46 that communicates with a controller 48 to provide an indication of when the door lock assembly 30 is properly locked. In this example, the locking portion 36 of the locking member 32 supports activating elements 52 and 54. The activating elements 52 and 54 are positioned on the locking portion 36 to interact with the proximity sensor elements 42 and 44, respectively, when the lock assembly 30 is properly locked.

Providing a plurality of sensor elements 42 and 44 provides redundancy for meeting code requirements to cover situations where one sensor element may fail. Providing a plurality of sensor elements 42 and 44 also allows for arranging the sensor elements in a particular geometric pattern and setting the activating elements 52 and 54 in a corresponding geometric pattern so that the sensor device 40 provides an indication of a properly locked door lock only when each sensor element interacts with a corresponding one of the activating elements. This strategic placement of sensor elements and activating elements effectively provides a key associated with each door lock to avoid an improper indication of a locked door condition.

Figure 3:
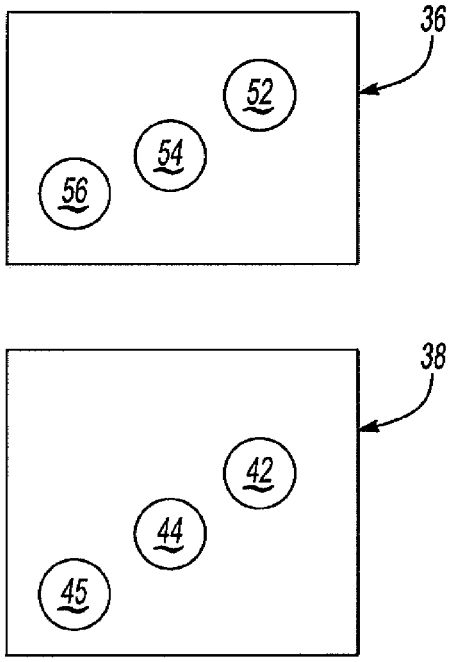
FIG. 3 schematically illustrates an example geometric pattern of sensor elements.

FIG. 3 schematically shows one example geometric pattern arrangement where sensor elements 42, 44 and 45 are aligned and corresponding activating elements 52, 54 and 56 are aligned so that they overlap in a manner that the sensor elements are activated by the presence of the activating elements when the door lock is in a locked position.

Figure 4:
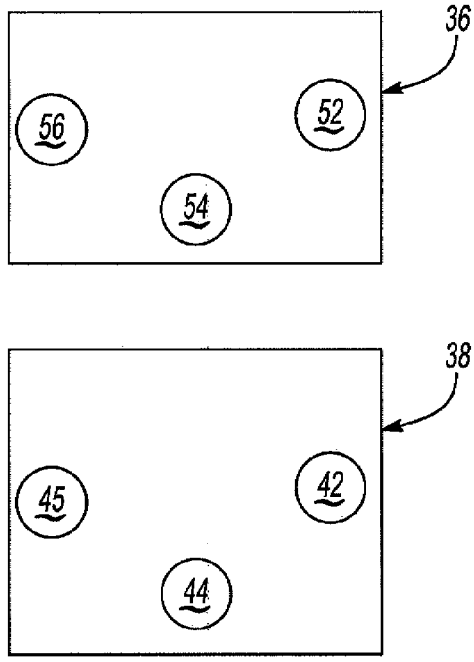
FIG. 4 schematically illustrates an alternative geometric pattern.

Another example geometric pattern is shown in FIG. 4. A variety of patterns are possible. Using a specific arrangement of the elements allows for customizing the arrangement and prevents an individual from overriding the sensor arrangement. Providing a false-positive indication of a door lock condition would require an individual to arrange activating elements consistent with the geometric pattern of the sensor elements, for example. By providing different patterns for a variety of door lock arrangements, such tampering can be prevented.

The sensor elements preferably are proximity sensor elements that do not require contact such as that required using a mechanical switch. In one example, the sensor elements comprise hall effect sensor elements that respond to a magnetic field caused by the appropriate presence of activating elements. In one example, the activating elements comprise magnets. One particular example has the sensor elements and activating elements arranged so that magnetic north or south is required in particular locations. Such an arrangement prevents, for example, an individual placing a single magnet over the field of all of the sensor elements to circumvent the sensor function. Having one of the sensor elements responsive only to magnetic north and another sensor element responsive only to magnetic south, for example, provides a robust arrangement.

Another example includes inductive sensor elements. Still another example includes opto-electronic sensor elements. Still another example includes a combination of two or more of such sensor elements.

Figure 5:
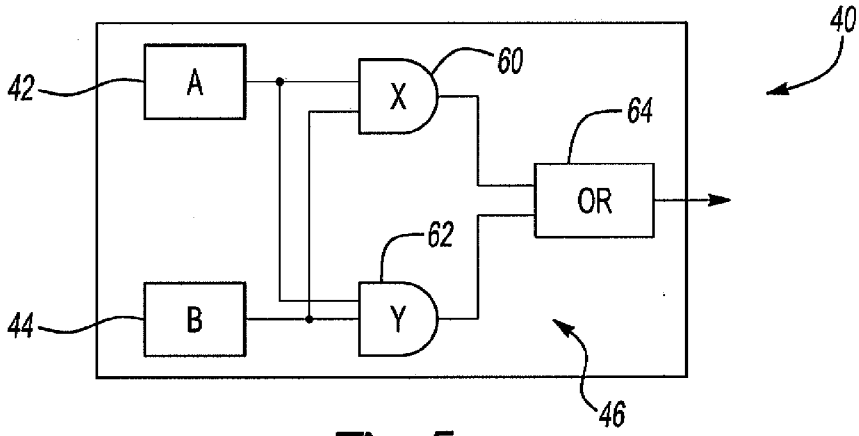
FIG. 5 schematically illustrates an example output circuit useful with the embodiment of FIG. 2, for example.

FIG. 5 schematically shows one example output circuit 46. In this example, sensor elements 42 and 44 provide output voltages responsive to appropriate interaction with an activating element, respectively. In the example of FIG. 5 AND gates 60 and 62 both receive the output voltages from the sensor elements 42 and 44. The output of the AND gates 60 and 62 are provided to an OR gate 64. When the sensor elements 42 and 42 are properly interacting with activating elements, they provide a voltage output that corresponds to a logic HIGH. Accordingly, the AND gates 60 and 62 forward an output signal through the OR gate 64 indicating that both of the sensor elements 42 and 44 are properly interacting with activating elements and the door is in a locked condition.

Two AND gates 60 and 62 are provided in the example of FIG. 5 for redundancy. If one of the AND gates 60 and 62 were to fail, the other would still provide a proper output through the OR gate 64 indicating a locked condition of the door.

If either of the sensor elements 42 or 44 is not properly interacting with an activating element (i.e., the locking portion 36 is not in the receiver 38), the output from the OR gate 64 is a logical LOW, which indicates an unlocked door condition in one example.

A variety of output circuits can be used to meet the needs of a particular situation. One example arrangement includes output circuits that provide a binary output for indicating when the door lock is in a locked condition. In one example, the binary output also provides an indication of a building level location of a particular sensor device. One example output circuit provides a binary output number to the controller 48 that allows the controller to determine which building levels have locked doors. Such an arrangement facilitates troubleshooting or maintenance because a sensor that provides a building level location indication allows a mechanic or technician to readily identify what building level requires service in the event of a callback, for example.

In one example, the controller 48 provides a building level indication of an unlocked door to a remote location so that a service technician arriving at a site already has information about which door lock (i.e., on which level) requires attention or maintenance. Such additional, useful information was not possible using traditional lock sensors that rely upon mechanical switches.

In one example, the plurality of sensor elements includes a number corresponding to the desired bits within a binary output. In another example, the configuration of the output circuit produces a binary output with a number of bits that exceeds the number of sensors. In the latter example, a two-sensor element sensor device provides a four bit binary output with a suitably designed output circuit. Those skilled in the art who have the benefit of this description will be able to select the number of sensor elements and the configuration of an output circuit to meet the needs of their particular situation.

In one example, the controller 48 includes a look up table that correlates the binary output numbers from the output circuits 46 with particular building levels. In one example, whenever a door lock is property locked, the controller 48 receives the corresponding binary output from the corresponding sensor device 40. By determining whether any of the binary output numbers is missing, the controller 48 determines that a particular door lock is unlocked (or at least the corresponding sensor device is not providing an indication that the lock is locked).

The disclosed examples include the advantages of avoiding maintenance costs associated with mechanical switches, avoiding easy tampering of lock sensors, providing redundancies to satisfy code requirements and providing location indications to facilitate more efficient troubleshooting or repair.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A sensor device for determining a condition of an elevator door lock, comprising:

a plurality of proximity sensor elements arranged in a selected geometric pattern and mountable on a portion of a single elevator door lock; and a plurality of activating elements mountable on another portion of the single elevator door lock and arranged in a corresponding geometric pattern so that each of the activating elements interacts with a corresponding one of the sensor elements when the activating elements are positioned relative to the sensor elements in a manner corresponding to a locked condition of the elevator door lock, and each of the activating elements continuously interacts with the corresponding sensor element until the elevator door lock moves into an unlocked condition.

2. The device of claim 1, wherein the sensor elements comprises Hall effect sensor elements.

3. The device of claim 2, wherein the activating elements comprises magnets.

4. The device of claim 1, wherein a first one of the sensor elements is responsive to magnetic north and a second one of the sensor elements is responsive to magnetic south.

5. The device of claim 1, including a controller that determines whether every activating element is interacting with the corresponding sensor element.

6. The device of claim 5, wherein the controller determines that the elevator door lock is in an unlocked condition whenever at least one of the activating elements is not interacting with the corresponding sensor element.

7. The device of claim 1, wherein the sensor elements each provide a voltage responsive to interaction with a corresponding one of the activating elements and wherein the voltages provide an indication of the condition of the elevator door lock.

8. The device of claim 1, including an output circuit that provides an indication that the elevator door lock is in the locked condition only when every sensor element is affected by the corresponding activating element.

9. The device of claim 1, including an output circuit that provides an indication of a location of the device.

10. The device of claim 9, wherein the output circuit provides a binary output indicative of the location.

11. An elevator door lock assembly, comprising:

a locking member of a single elevator door lock;

a lock receiver of the single elevator door lock that receives at least a portion of the locking member for selectively locking an elevator door in a closed position;

a plurality of proximity sensor elements arranged in a selected geometric pattern and supported on one of the locking member or the lock receiver; and a plurality of activating elements arranged in a corresponding geometric pattern and supported on the other of the lock receiver or the locking member so that each of the activating elements interacts with a corresponding one of the sensor elements when the lock receiver receives at least the portion of the locking member.

12. The assembly of claim 11, wherein the sensor elements comprises Hall effect sensor elements.

13. The assembly of claim 11, including a controller that determines whether every activating element is interacting with the corresponding sensor element.

14. The assembly of claim 13, wherein the controller determines that the elevator door lock is in an unlocked condition whenever at least one of the activating elements is not interacting with the corresponding sensor element.

15. The assembly of claim 11, wherein the sensor elements each provide a voltage responsive to interaction with a corresponding one of the activating elements and wherein the voltages provide an indication of the condition of the elevator door lock.

16. The assembly of claim 11, including an output circuit that provides an indication that the elevator door lock is in the locked condition only when every sensor element is affected by the corresponding activating element.

17. The assembly of claim 11, including an output circuit that provides an indication of a building level location of the sensor elements.

18. A sensor device for determining a condition of a plurality of elevator door locks, comprising:

at least one proximity sensor element associated with each elevator door lock that senses whether the associated elevator door lock is in a locked condition; and an output circuit responsive to each proximity sensor that provides an output indicative of whether the associated elevator door lock is in a locked condition and indicative of a building level location of the associated elevator door lock, wherein each proximity sensor comprises a plurality of proximity sensor elements arranged in a selected geometric pattern and a plurality of activating elements arranged in a corresponding geometric pattern so that the output circuit provides the output indicative of the lock being in a locked condition when each of the activating elements interacts with a corresponding one of the sensor elements when the activating elements are positioned relative to the sensor elements in a manner corresponding to a locked condition of the associated elevator door lock, and wherein the geometric pattern of one of the proximity sensors is different than the geometric pattern of at least one other of the proximity sensors.

19. The device of claim 18, including at least one proximity sensor element and a corresponding output circuit located at each one of a plurality of different building levels and a controller that receives the indications from the output circuits and determines whether an elevator door lock at each of the building levels is in a locked condition.

20. A sensor device for determining a condition of an elevator door lock, comprising:

a plurality of proximity sensor elements arranged in a selected geometric pattern and mountable on a portion of a single elevator door lock; and a plurality of activating elements mountable on another portion of the single elevator door lock and arranged in a corresponding geometric pattern so that each of the activating elements interacts with a corresponding one of the sensor elements when the activating elements are positioned relative to the sensor elements in a manner corresponding to a locked condition of the elevator door lock, wherein a first one of the sensor elements is responsive to magnetic north and a second one of the sensor elements is responsive to magnetic south.

* * * * *

UNITED STATES PATENT AND TRADEMARK OFFICE

CERTIFICATE OF CORRECTION

PATENT NO. : 7,650,970 B2
APPLICATION NO. : 11/570892
DATED : January 26, 2010
INVENTOR(S) : Lelic et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 446 days.

Signed and Sealed this

Twenty-third Day of November, 2010

David J. Kappos

David J. Kappos
*Director of the United States Patent and Trademark Office*